United States Patent [19]

Bai

[11] 4,053,156

[45] Oct. 11, 1977

[54] BALL FOR TARGET DART GAME

[76] Inventor: Henry S. Bai, 421-14 Picadilly Place, San Bruno, Calif. 94066

[21] Appl. No.: 717,640

[22] Filed: Aug. 25, 1976

[51] Int. Cl.[2] ..... A63B 65/00

[52] U.S. Cl. ..... 273/106 R; 273/106.5 A; 273/58 K; 46/DIG. 1; 273/65 ED

[58] Field of Search ..... 273/58 K, 81.5, 65 ED, 273/95 R, 106 R, 106.5 A, 181 B, 61 A, 95 A; 40/327; 46/DIG. 1

[56] References Cited

U.S. PATENT DOCUMENTS

| | | | |
|---|---|---|---|
| 3,140,873 | 7/1964 | Goodwin | 273/81.5 |
| 3,848,480 | 11/1974 | Oseroff | 273/81.5 |
| 3,917,271 | 11/1975 | Lemelson | 273/58 K |

*Primary Examiner*—George J. Marlo

*Attorney, Agent, or Firm*—Keith D. Beecher

[57] ABSTRACT

A ball is provided for use in a target dart game, which game includes a target formed of a sheet of fabric having upstanding filamentary elements adapted to engage and hold the ball against that portion of the target struck by the ball, as the ball is thrown against the target. The ball has strips of Velcro material attached thereto. Bushings are provided in diametrically opposite positions on the ball, and plugs are inserted into the bushings and are frictionally held therein. The heads of the plugs extend over the ends of the Velcro strips, so that such ends are anchored in place by the plugs. This provides for a simple and inexpensive means for securing the Velcro strips to the ball without any tendency for the ends of the strips to curl outwardly or peel off the surface of the ball.

5 Claims, 2 Drawing Figures

BALL FOR TARGET DART GAME

BACKGROUND OF THE INVENTION

Target games are known to the art in which balls partially covered with strips of Velcro material are thrown at a fabric target, with the balls being held against the target upon contact. Such games are similar to traditional dart games, but are not dangerous because the heavy, sharp and pointed darts of the traditional dart games are replaced by light harmless balls.

A problem has been encountered in the prior art, however, in providing sufficient strips of Velcro on the individual balls so that the balls will invariably be held against the target on contact, and will not bounce off; and at the same time in providing a simple and economical means for attaching the Velcro strips to the smooth surface of the ball in such a manner that the ball will not become off-balanced, and in such a manner that there will be no tendency for the strips to become detached from the ball.

This problem is solved by the construction of the present invention in which, as will be described, the ends of the Velcro strips are securely anchored into depressions at diametrically opposite positions on the ball by simple plugs which are frictionally held in bushings formed integral with the ball at the diametrically opposite locations.

DETAILED DESCRIPTION OF THE ILLUSTRATED EMBODIMENT

The ball forming the subject matter of the present invention is intended for use in a target game, which includes a target formed of a sheet fabric having upstanding filamentary elements adapted to engage and hold the ball against the portion of the target struck by the ball as the ball is thrown against the target.

Figure 1:
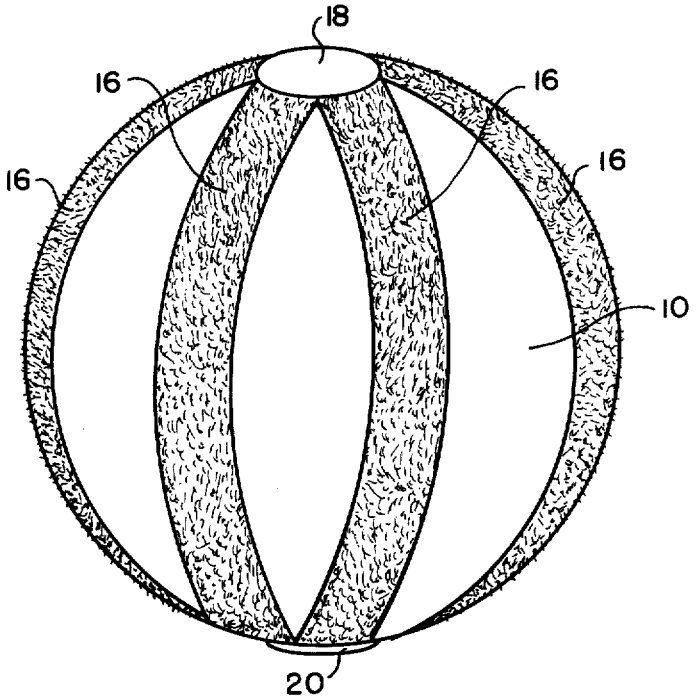
FIG. 1 is a side elevation of a ball constructed in accordance with the present invention.
Figure 2:
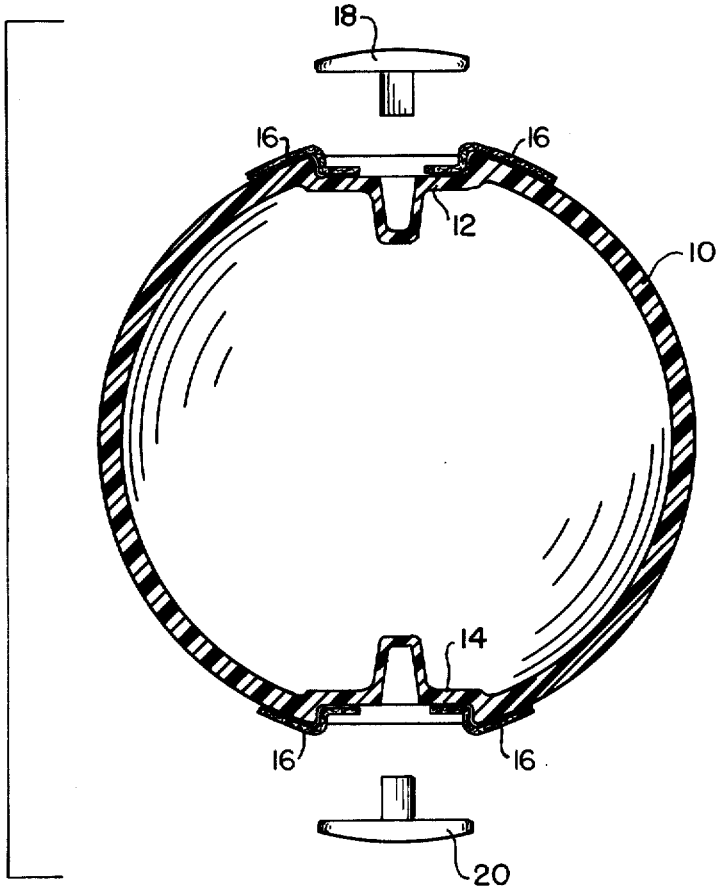
FIG. 2 is a cross-section of the ball of FIG. 1, with the Velcro strips removed, and with the plug shown detached from corresponding bushings in the ball.

The ball is designated 10 in FIGS. 1 and 2. It comprises a thin-walled light-weight spherical-spaced hollow body, and it may be formed, for example, either of a single blow molding, or a two-piece injection molding. The ball is composed, for example, of appropriate plastic, such as polystyrene, polyethylene, polypropylene, or the like.

A pair of diametrically opposite bushings 12 and 14 are formed integral with the ball 10, and each bushing forms a depression at the surface of the ball. A plurality of Velcro strips 16 are wrapped around the ball, as shown in FIG. 1, and adhesively attached to the surface of the ball by any appropriate adhesive. The ends of the strips 16 extend into the depressions formed by the bushings 12 and 14.

A pair of plugs 18 and 20 are provided, and these plugs are received in the bushings 12 and 14, respectively, to be held in frictional engagement with the respective bushings. The heads of the respective plugs 18 and 20 extend across the corresponding ends of the Velcro strips 16, to anchor the ends firmly into the depressions formed by the bushings. The diameter of the heads of the respective plugs 18, 20 correspond to the diameter of the respective depressions, so that the plugs are essentially flush with the outer surfaces of the Velcro strips.

While a particular embodiment of the invention has been shown and described, modifications may be made. It is intended in the claims to cover the modifications which come within the true spirit and scope of the invention.

What is claimed is:

1. A ball for use in a target game, which game includes a target formed of a sheet of fabric having upstanding filamentary elements adapted to engage and hold the ball against that portion of the target struck by the ball as the ball is thrown against the target, the ball comprising: a light-weight spherical-shaped body; a pair of diametrically opposite bushings mounted on said spherical-shaped body; a plurality of strips of Velcro material mounted on said spherical-shaped body with the respective ends of each such strip extending partially across respective ones of said bushings; and a plurality of plugs respectively mounted in said bushings, each of said plugs having a head extending across the corresponding ends of said Velcro strips to maintain said ends in engagement with the surface of said spherical-shaped body.

2. The ball defined in claim 1, in which said spherical-shaped body comprises a thin-walled hollow member.

3. The ball defined in claim 1, in which said Velcro strips are adhesively attached to the surface of said spherical-shaped body.

4. The ball defined in claim 1, in which said plugs extend into said bushings in frictional engagement therewith.

5. The ball defined in claim 1, in which said bushings are integral with said spherical-shaped body, and in which each of said bushings forms a corresponding depression at the surface of said body for receiving the corresponding ends of the Velcro strips, and for receiving the heads of said plugs so that the heads are flush with the outer surfaces of said Velcro strips.

* * * * *